US006322418B1

(12) United States Patent
Hippely et al.

(10) Patent No.: US 6,322,418 B1
(45) Date of Patent: Nov. 27, 2001

(54) TOY AIRSHIP ALTERNATELY CONFIGURABLE AS A HYDROFOIL CRAFT

(75) Inventors: Keith A. Hippely, Manhattan Beach; Randolph Cyr, Culver City, both of CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/497,441

(22) Filed: Feb. 3, 2000

(51) Int. Cl.[7] ..... A63H 27/00
(52) U.S. Cl. ..... 446/230; 446/487
(58) Field of Search ..... 446/230, 231, 446/487, 30, 34, 46

(56) References Cited

U.S. PATENT DOCUMENTS

| | | | | |
|---|---|---|---|---|
| D. 86,219 | | 2/1932 | Collette . | |
| D. 287,037 | | 12/1986 | Matsushiro . | |
| D. 287,378 | | 12/1986 | Ohno . | |
| D. 288,216 | | 2/1987 | Jensen . | |
| D. 289,426 | | 4/1987 | Lim . | |
| D. 290,480 | | 6/1987 | Maruyama . | |
| D. 290,481 | | 6/1987 | Kitamura . | |
| D. 293,803 | | 1/1988 | Doi . | |
| D. 293,804 | | 1/1988 | Doi . | |
| D. 293,805 | | 1/1988 | Matsumoto . | |
| D. 293,806 | | 1/1988 | Shibukawa . | |
| D. 295,994 | | 5/1988 | Matsumoto . | |
| D. 297,038 | | 8/1988 | Ohino . | |
| D. 303,411 | | 9/1989 | Matsuda . | |
| D. 329,886 | | 9/1992 | Fujitani . | |
| 1,561,721 | | 11/1925 | Humphrey . | |
| 2,503,707 | * | 4/1950 | Braman | 446/230 |
| 3,092,060 | | 6/1963 | Reid . | |
| 4,043,075 | * | 8/1977 | Breneman | 446/230 |
| 4,500,299 | * | 2/1985 | Kelley et al. | 446/230 |
| 4,668,205 | * | 5/1987 | Choy et al. | 446/230 |
| 4,681,554 | * | 7/1987 | Hsien-Yang | 446/231 |
| 4,799,914 | | 1/1989 | Hutchinson . | |
| 4,940,195 | * | 7/1990 | Jackson | 446/487 |
| 5,019,010 | * | 5/1991 | Nikaido et al. | 446/230 |
| 5,297,759 | | 3/1994 | Tilbor et al. . | |
| 5,924,910 | * | 7/1999 | Liu | 446/487 |
| 6,000,988 | * | 12/1999 | Tsai | 446/231 |

FOREIGN PATENT DOCUMENTS

| | | |
|---|---|---|
| 396087 | 4/1909 | (FR) . |
| 433269 | 12/1911 | (FR) . |
| 46855 | of 1909 | (GB) . |
| 6512 | of 1909 | (GB) . |
| 288895 | 4/1928 | (GB) . |

* cited by examiner

*Primary Examiner*—Sam Rimell
(74) *Attorney, Agent, or Firm*—Roy A. Ekstrand

(57) ABSTRACT

A toy airship includes an elongated hull having a generally. circular cross section which includes a pair of panels. The panels are movably supported with respect to the remainder of the airship hull by a plurality of pivotally supported arms. The interior ends of the pivotally supported arms are secured to a movable slide which is positioned by a return spring so-as-to pivot the supporting arms of the panels forwardly and outwardly thereby extending the movable panels to reconfigure the toy airship in a hydrofoil craft configuration. A movable button is operative coupled to the slide and is used to drive the slide forwardly against the return spring and thereby pivot the panel supporting arms rearwardly and inwardly. As the arms are pivoted rearwardly and inwardly, the panels are configured into a closed position resulting in reconfiguring the toy airship in its airship resembling configuration.

8 Claims, 3 Drawing Sheets

10
11
12
13
14
15
16
17
18
20
21
22
23
30
31
32
33
36
37
40
41
42
43
50
51
52
53
60
61
62
63
70
71
72
73

TOY AIRSHIP ALTERNATELY CONFIGURABLE AS A HYDROFOIL CRAFT

FIELD OF THE INVENTION

This invention relates generally to toys capable of multiple appearances and configurations and particularly to those in which the alternate configurations form distinct types of vehicles.

BACKGROUND OF THE INVENTION

Toys which are capable of transformation between alternate shapes or configurations are well known in the art. Typically, such alternately configurable toys are formed of a plurality of components which are variously coupled and articulated to be moved into alternative positions relative to each other. In most such toys, the alternate configurations result in different shapes and characters for the toy. Most such alternately configurable toys are formed of molded plastic elements which are often highly detailed and which produce distinctly different types of toys in their alternate configurations. Thus, for example, such toys often are alternately configurable between some type of vehicle and some type of fanciful creature such as a robot. Still others, are provided which produce alternate configurations which are both vehicles but which are vehicles but which are vehicles of decidedly different character such as an airplane transformable into a truck or the like.

Notsurprisingly, such alternately configurable toys have been provided in many varieties and types by practitioners in the art. For example, U.S. Pat. No. Des.295,994 issued to Matsumoto sets forth a RECONFIGURABLE TOY AIRCRAFT CARRIER having a plurality of articulated components transformable between a toy robot and an aircraft carrier and further transformable into an aircraft.

U.S. Pat. No. Des.287,037 issued to Matsushiro sets forth a CHANGEABLE ROBOT TOY alternately configurable between a robot and an aircraft.

U.S. Pat. No. Des.287,378 issued to Ohno sets forth a RECONFIGURABLE JET PLANE TOY alternately configurable between an aircraft, a tank and a fanciful robot.

U.S. Pat. No. Des.289,426 issued to Lim sets forth a RECONFIGURABLE TOY ROBOT alternately configured as an aircraft or a robot.

U.S. Pat. No. Des.290,480 issued to Maruyama sets forth a RECONFIGURABLE TOY AIRPLANE alternately configurable between a robot and a toy airplane.

U.S. Pat. No. Des.290,481 issued to Kitamura sets forth a RECONFIGURABLE TOY BOAT transformable between a robot and a hovercraft type boat.

U.S. Pat. Nos. Des.293,803 and 293,804 both issued to Doi each set forth similar RECONFIGURABLE TOY JET PLANES which alternately form between a jet plane and a robot.

U.S. Pat. No. Des.293,805 issued to Matsumoto sets forth a RECONFIGURABLE TOY JET PLANE capable of alternate configuration between a jet plane and a robot.

U.S. Pat. No. Des.293,806 issued to Shibukawa sets forth a RECONFIGURABLE TOY SPACE SHUTTLE capable of alternate configuration between a space shuttle and a robot.

U.S. Pat. No. Des.297,038 issued to Ohno sets forth a RECONFIGURABLE TOY VEHICLE TANKER capable of alternate configuration between a toy robot, a toy jet airplane a tanker type truck toy.

U.S. Pat. No. Des.303,411 issued to Matsuda sets forth a RECONFIGURABLE TANK AND JET ASSEMBLY TOY capable of alternate configuration between a robot-type toy and a jet aircraft and mobile launcher device.

British patent 288,895 issued to White; U.S. Pat. No. 1,561,721 issued to Humphrey; U.S. Pat. No. Des.288,216 issued to Jensen and U.S. Pat. No. Des.86,219 issued to Collette set forth various toy airships and balloons of different designs. Additional toy balloons and airships are shown in German patent 6512 issued to Wagemann and British patent 46855 also issued to Wagemann. Further toy airships and balloons are shown in French patent 433,269 issued to Glaubitz and French patent 396,087 issued to Grimm as well as U.S. Pat. No. 4,799,914 issued to Hutchinson.

U.S. Pat. No. 3,092,060 issued to Reid sets forth a FLYING SUBMARINE having a submarine-like fuselage which supports a pair of retractable wings.

U.S. Pat. No. 4,681,554 issued to Hsien-yang sets forth a TOY DEVICE WHICH CAN BE OPENED AND POSITIONED AT ANY DESIRED ANGLE in which a toy space shuttle includes a pair of openable and closeable cargo compartment doors.

U.S. Pat. No. Des.329,886 issued to Fugitani sets forth an AIR CUSHION BOAT TOY while U.S. Pat. No. 5,297,759 issued to Tilbor et al. sets forth a ROTARY AIRCRAFT PASSIVELY STABLE IN HOVER.

While the foregoing described prior art devices have to some extent improved the art and in some instances enjoyed commercial success, there remains nonetheless a continuing need in the art for ever more improved, interesting and amusing toys capable of alternate configurations.

SUMMARY OF THE INVENTION

Accordingly, it is a general object of the present invention to provide an improved toy capable of alternate configuration. It is a more particular object of the present invention to provide an improved toy capable of alternate configuration which operates in response to a single movable actuating member.

In accordance with the present invention there is provided a toy airship configurable between a closed airship configuration and an open hydrofoil craft configuration, the toy airship comprising: an elongated hull defining side edges and a rear edge; a pair of panels formed to fit upon the hull at the side and rear edges; a slide movably supported within the hull; a first pair of arms pivotally joined to the slide and pivotally joined to one of the panels; a second pair of arms pivotally joined to the slide and pivotally joined to the remaining one of the panels; user operable means for moving the slide between a first position moving the panels to the closed airship configuration and a second position moving the panels to the hydrofoil craft configuration.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
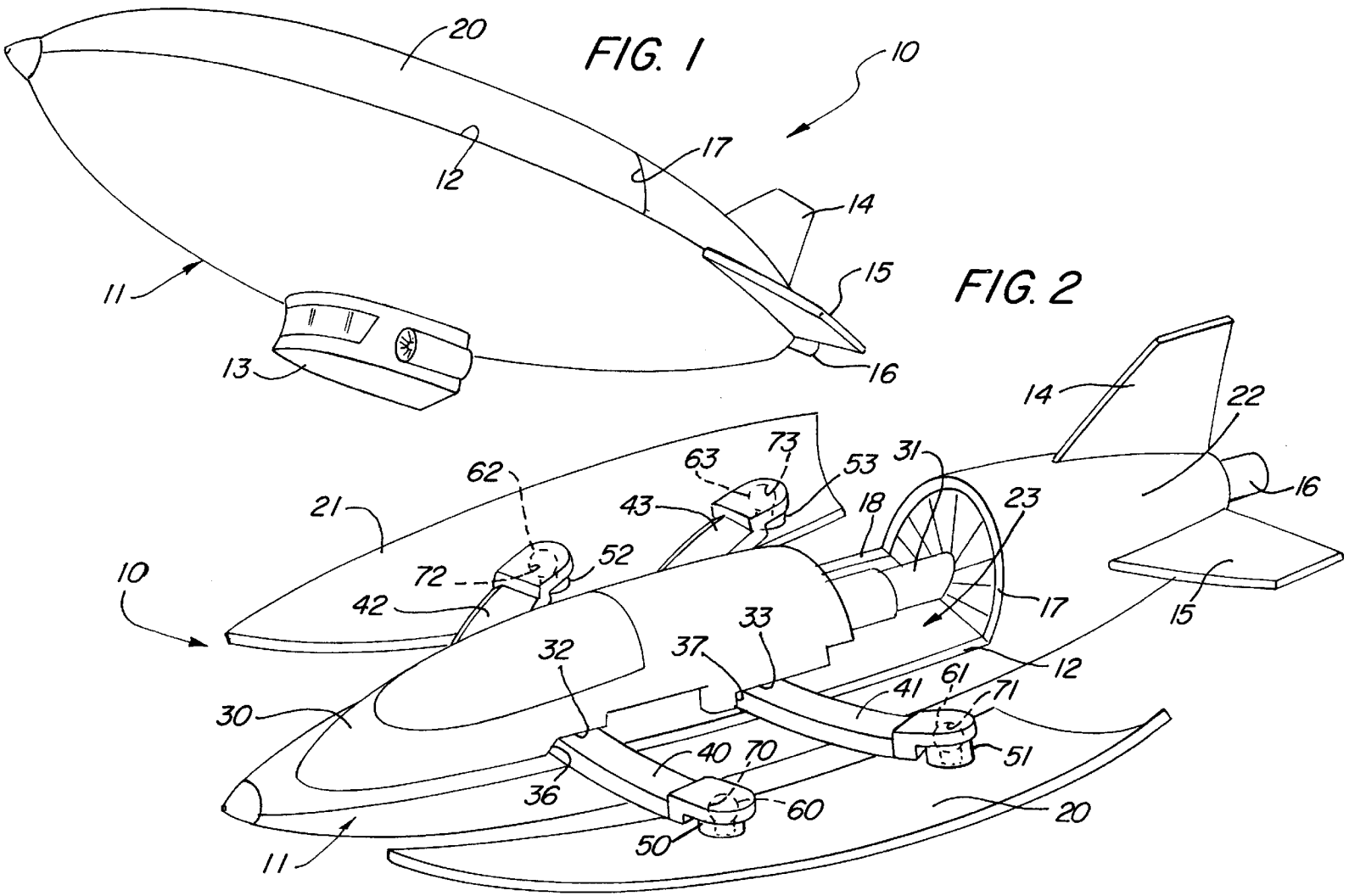
FIG. 1 sets forth a perspective view of the present invention toy in its airship configuration.
FIG. 2 sets forth a perspective view of the present invention toy in its hydrofoil configuration.

FIG. 1 sets forth a perspective view of a toy airship constructed in accordance with the present invention and generally referenced by numeral 10. Toy airship 10 includes an elongated hull 11 having a pair of movable panels 20 and 21 (panel 21 seen in FIG. 2). Toy airship 10 further includes a plurality of simulated guiding fins including a vertically extending tail fin 14 as well as horizontal fins 15 and 19 (fin 19 seen in FIG. 3). Panel 20 is joined to the remainder of hull 11 along an edge 12 and an edge 17. As is better seen in FIG. 2, panel 21 is similarly joined to the remainder of hull 11 along an edge 18 and edge 17. In accordance with the typical fabrication of a toy airship, toy airship 10 further includes a simulated pilots cabin 13 on the under side thereof.

In accordance with an important aspect of the present invention, hull 11 further supports a movable push-button 16 extending rearwardly from hull 11. In accordance with the operation of the present invention toy set forth and described below, toy 10 assumes the closed configuration defining a toy airship as shown in FIG. 1 so long as push-button 16 is forced inwardly into hull 11. In further accordance with the present invention, and as is set forth below in FIG. 2, the release of push-button 16 by the user allows the operative mechanism described below in FIGS. 3 through 5 to reconfigure toy 10 to the hydrofoil craft configuration shown in FIG. 2. In further accordance with the present invention, the child user returns toy 10 to the closed airship resembling configuration shown in FIG. 1 by again forcing push-button 16 inwardly into hull 11.

FIG. 2 sets forth a perspective view of toy airship 10 in its alternate configuration in which it resembles a hydrofoil watercraft. As described above, toy 10 includes an elongated hull 11 having edges 12, 17 and 18 formed therein and further including a pair of movable panels 20 and 21. Panels 20 and 21 are shaped and sized to form the completion of the outer surface of hull 11 in the airship configuration shown in FIG. 1. Panels 20 and 21 are further configured to define downwardly facing convents curved surfaces which lend further realism to a hydrofoil-type craft. As is also described above, hull 11 further supports a vertical tail fin 14 and horizontal tail fins 15 and 19 (fin 19 seen in FIG. 3).

With panels 20 and 21 extending outwardly as shown in FIG. 2, hull 11 exposes an interior cavity 23 within which a simulated hydrofoil cockpit 30 is supported. A tunnel 31 extends through interior cavity 23 and communicates with the interior of cockpit 30. Push-button 16 is shown in its relaxed position at the rear of hull 11 which as is described below in greater detail allows toy airship 10 to assume the alternate configuration of FIG. 2.

Panels 20 and 21 are supported in the extended position of FIG. 2 by a cortex of pivotally supported arms 40, 41, 42 and 43. Arm 40 extends inwardly through a slot 32 formed in cockpit 30 while arm 41 extends inwardly through a slot 33 also formed in cockpit 30. While not seen in FIG. 2, it will be understood that cockpit 30 defines a similar pair of slots 32 and 33 (shown in FIG. 3) through which arms 42 and 43 extend.

Arm 40 defines a socket 70 at its outer end while arm 41 defines a socket 71 at its outer end. Correspondingly, panel 20 defines a pair of posts 50 and 51 which in turn support a pair of balls 60 and 61. The cooperation of ball 60 within socket 70 and ball 61 within socket 71 provide a freely pivotable attachment between panel 20 and the outer ends of arms 40 and 41. As is set forth below in FIGS. 4 and 5, the operation of the ball and socket attachments thus formed allows panel 20 to articulate and move to the closed configuration of FIG. 1 when arms 40 and 41 are drawn into interior cavity 23.

Similarly, arms 42 and 43 define respective sockets 72 and 73 while panel 21 defines a pair of posts 52 and 53 supporting respective balls 62 and 63. In similarity to panel 20, the cooperation of ball 62 within socket 72 and ball 63 within socket 73 provides a freely articulated attachment for panel 21 to the outer ends of arms 42 and 43. This freely articulated attachment allows panel 21 to pivot and move in a closure movement as arms 42 and 43 are pivoted into interior cavity 23 which in turn allows panel 21 to be moved to the closed configuration of FIG. 1.

Figure 3:
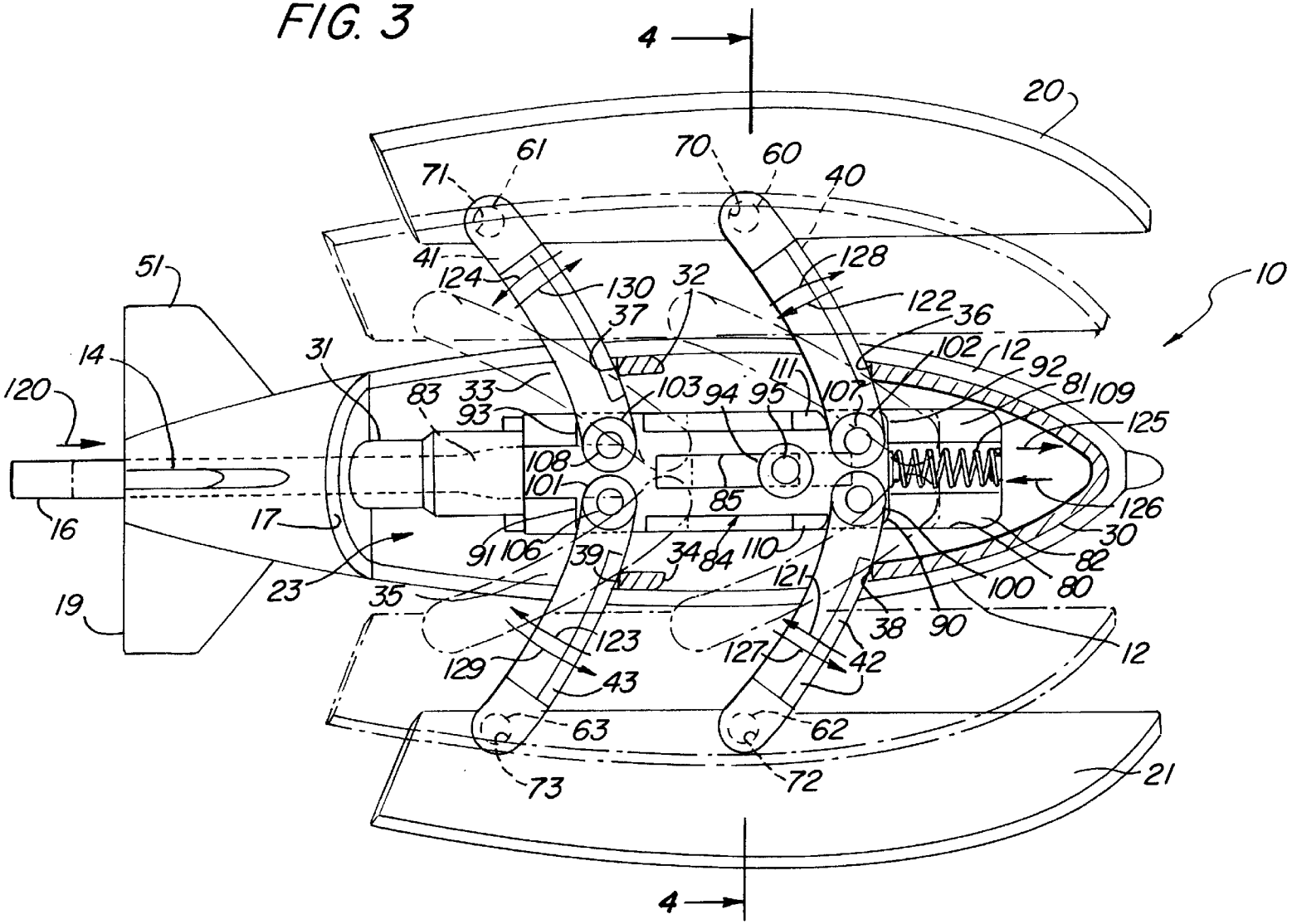
FIG. 3 sets forth a partially sectioned top view of the present invention toy in its hydrofoil configuration.

Cockpit 30 allows defines stop edges 36 and 37 in slots 32 and 33 respectively, as well as corresponding stop edges 38 and 39 in slots 34 and 35 (seen in FIG. 3). As is described below in greater detail, the configuration of toy airship 10 from the hydrofoil configuration shown in FIG. 2 to the closed airship shown in FIG. 1 is attained in part by the cooperation of arms 40 through 43 against stops 36 through 39. This cooperation is carried forward in the manner set forth below in FIGS. 3 through 5. However, suffice it to note here, that as the user presses button 16 inwardly and forwardly within hull 11, the operative mechanism set forth below carries the interior ends 40 through 43 forwardly against stops 36 through 39 respectively. This cooperation in turn causes arms 40 through 43 to pivot rearwardly and inwardly drawing panels 20 and 21 into the closed configuration of FIG. 1 in the manner particularly illustrated in FIGS. 4 and 5. Conversely, each time the user releases button 16 the operative mechanism set forth below again allows arms 40 through 43 to pivot outwardly and thereby support panels 20 and 21 in the extended hydrofoil craft configuration of FIG. 2. Thus, the entire configuration and reconfiguration of toy airship 10 is carried forward by simply pressing button 16 inwardly and holding it within hull 11 or alternatively releasing it. This greatly simplifies the configuration of toy 10 between its alternate configurations.

FIG. 3 sets forth a partially sectioned top view of toy airship 10 in the hydrofoil configuration shown in FIG. 2. As described above, toy airship 10 includes an elongated hull 11 supporting a vertical tail fin 14 and horizontal tail fins 15 and 19. Hull 11 further defines edges 12, 17 and 18. A cockpit 30 is supported within hull 11 and an elongated hollow tunnel 31 extends to cockpit 30. Cockpit 30 defines elongated slots 32, 33, 34 and 35. The forward edges of slots 32 through 35 define respective stop edges 36 through 39. Hull 11 further defines an elongated channel 80 within which a pair of guide surfaces 81 and 82 are supported. A slide 84 is received within channel 80 and movable upon guide surfaces 81 and 82 in a front-to-back motion as indicated by arrows 125 and 126. Slide 84 includes a pair of outwardly extending front flanges 90 and 92 and a pair of outwardly extending rear flanges 91 and 93. Slide 84 further defines an elongated slot 85 which receives the upper end of a guide post 86 (seen in FIG. 4). Post 86 captivates slide 84 within channel 80 by the attachment of an annular guide 94 to the upper end of post 86 using a conventional fastener 95.

A coil spring 109 is supported within hull 11 and exerts a spring force against slide 984 urging in rearwardly in the direction indicated by arrow 126 configuring toy airship 10 in the position shown in solid line representation in FIG. 3.

Arm 40 is pivotally secured to flange 92 by a fastener 107 and a washer 102. Similarly, arm 42 is pivotally secured to flange 90 by a fastener 105 and a washer 100. Arms 41 and 43 are similarly secured to flanges 93 and 91 respectively in a pivotal attachment using fasteners 108 and 106. Button 15 is joined to an inwardly extending shaft 83 which passes through tunnel 31 and which is joined to the rear portion of slide 84. Thus, forces exerted by the user against button 16 are imparted to slide 84. Correspondingly, forces exerted against slide 84 by spring 109 are imparted to button 16 by shaft 83.

In the open configuration shown in solid line representation in FIG. 3, toy airship 10 has assumed a hydrofoil craft configuration as a result of the absence of an inward force upon button 16 by the user. In the absence of any force against button 16, the force of spring 109 in the direction indicated by arrow 126 against slide 84 moves slide 84 rearwardly. The rearward movement of slide 84 in the direction of arrow 126 correspondingly moves the interior pivotally attached ends of arms 40 through 43. A pair of stops 110 and 111 are supported upon guide surfaces 82 and 81 respectively within channel 80 and within the travel path of arms 40 and 42 as slide 84 moves rearwardly. Thus, as spring 109 continues to force slide 84 in the direction indicated by arrow 126, the cooperation of stops 111 and 110 against arms 40 and 42 produces a force upon arms 40 and 42 which pivots them in the directions indicated by arrows 128 and 127. The joint coupling at the outer end of arms 40 and 41 provided by balls 60 and 61 and sockets 70 and 71 communicates the forward pivotally movement of arm 40 to arm 41 causing arm 41 to also pivot in the direction indicated by arrow 130. Similarly, the attachment provided by balls 62 and 63 and sockets 72 and 73 of arms 42 and 43 communicates the pivotal movement of arm 42 to arm 43 causing arm 43 to be pivoted in the direction indicated by arrow 129. As a result, toy airship 10 assumes and maintains the open configuration shown in solid line representation in FIG. 3.

In accordance with the present invention, toy airship 10 is capable of being reconfigured to the airship configuration illustrated in FIG. 1 by the user simply forcing button 16 inwardly in the direction indicated by arrow 120. As the user presses button 16 forwardly in the direction indicated by arrow 120 the force against button 16 is communicated by shaft 83 to slide 84. As the user overcomes the force of spring 109, slide 84 is forced forwardly in the direction indicated by arrow 125. The forward movement of slide 84 carries arms 40 through 43 against stops 36 through 39 respectively. As the user continues to force button 16 forwardly and continues to drive slide 84 in the direction indicated by arrow 125, the cooperation of stops 36 through 39 and the pivotal attachment of arms 40 through 43 causes arms 40 through 43 to pivot inwardly. Thus, as slide 84 moves forward, arm 40 is pivoted in the direction indicated by arrow 122 while arm 42 is pivoted in the direction indicated by arrow 121. Correspondingly, arm 41 is pivoted in the direction indicated by arrow 124 while arm 43 is pivoted in the direction indicated by arrow 123. The rearward and inward pivotal movement of arms 40 through 43 draws panels 20 and 21 inwardly against hull 11 through the dashed line configuration shown in FIG. 3. As the forward movement of slide 84 continues the pivotal movement of arms 40 through 43 draws panels 20 and 21 into the closed configuration shown in FIG. 1.

Figure 4:
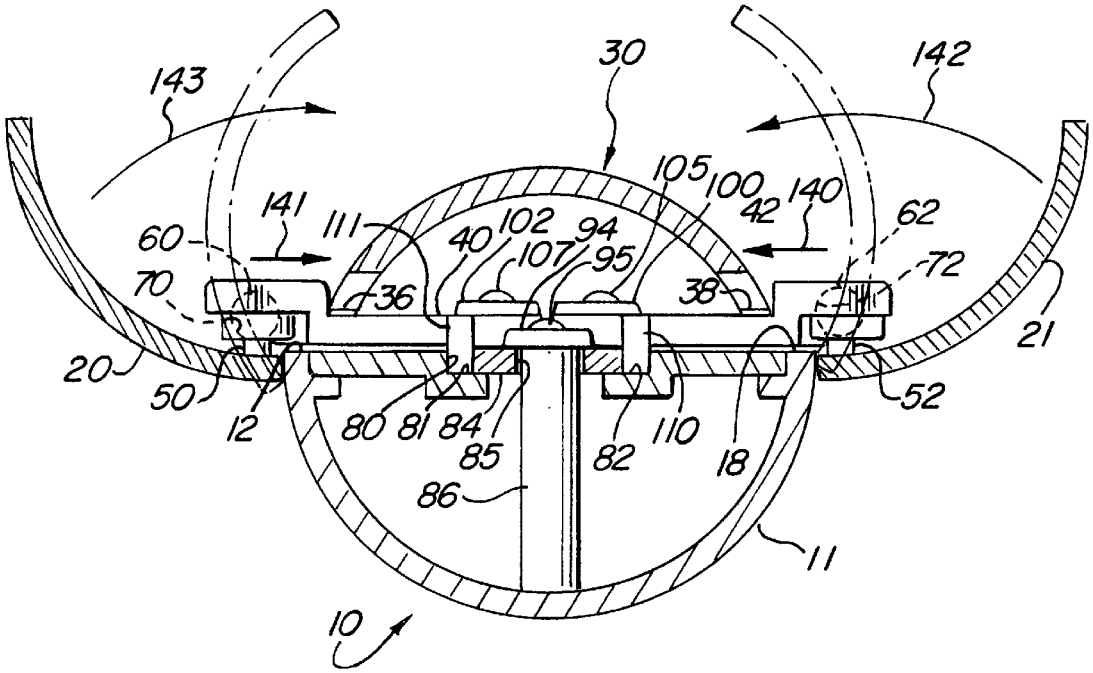
FIG. 4 sets forth a partial section view of the present invention toy taken along section line 4—4 in FIG. 3.
Figure 5:
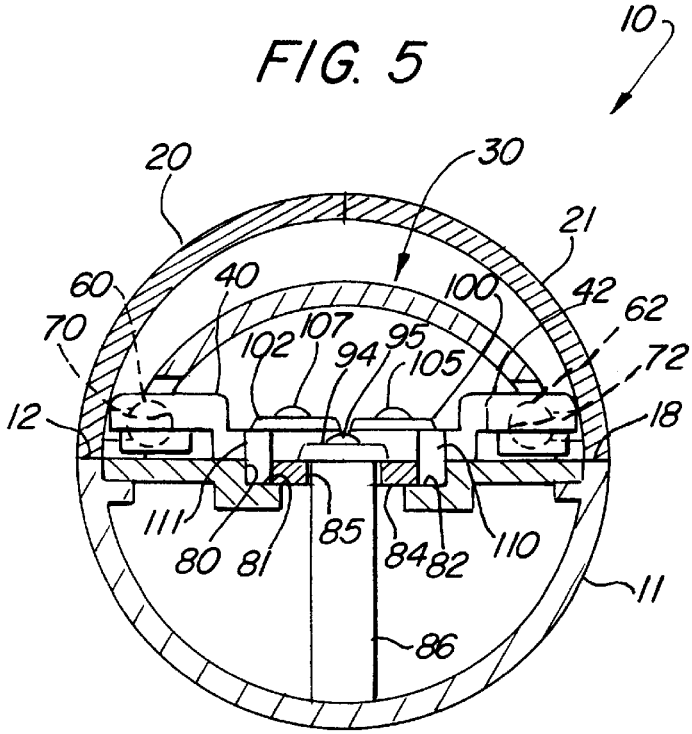
FIG. 5 sets forth a section view of the present invention toy taken along section line 4—4 having the toy in its airship configuration.

FIGS. 4 and 5 illustrate the configuration of toy airship 10 from the open configuration of FIGS. 2 and 3 to the closed configuration shown in FIG. 1. It will be noted that FIG. 4 shows a section view of toy airship 10 taken along section lines 4—4 in FIG. 3 showing toy airship 10 at the approximate point of the reconfiguration process shown in dashed line representation in FIG. 3. FIG. 5 shows the same section view as FIG. 4 taken along section lines 4—4 in FIG. 3, with toy airship 10 fully closed in the configuration illustrated in FIG. 1.

More specifically, toy airship 10 includes a hull 11 supporting a post 86. Hull 11 further defines edges 12 and 18 together with an interior cavity 23. Toy airship 10 further includes a cockpit 30 having stops 36 and 38 formed therein. Hull 11 further includes a channel 80 having guide surfaces 81 and 82 formed therein. A slide 84 is movably supported within channel 80 upon surfaces 81 and 82. Slide 84 further defines a slot 85 through which the upper end of post 86 extends. A guide washer 94 and fastener 95 are secured to the upper end of post 86 captivating slide 84 within channel 80. Channel 80 further supports a pair of stop members 110 and 111 each supported upon respective surfaces 82 and 81.

Toy 10 further includes a pair of arms 40 and 42 pivotally secured to slide 84 by respective fasteners 107 and 105 together with respective washers 102 and 100. The outer end of arm 40 defines a socket 70 which receives a ball 60. Ball 60 is secured to panel 20 by a post 50. Similarly, the outer end of arm 42 defines a socket 72 which receives a ball 62. Ball 62 is supported upon panel 21 by a post 52.

In the configuration shown in FIG. 4, toy airship 10 is undergoing the above described transformation from the open configuration of FIG. 2 to the closed configuration of FIG. 1. As described above, the forward movement of slide 84 forces arms 40 and 42 against stops 111 and 110 respectively. The cooperation of stops 111 and 110 with arms 40 and 42 causes arms 40 and 42 to be pivoted inwardly as indicated by arrows 141 and 140. As is also described above, a corresponding inward pivotal motion is imparted to arms 41 and 43 due to the coupling of arms 40 and 42 to panels 20 and 21. Thus, while not seen in FIG. 4, it will be understood that a similar rearward and inward pivotal movement is occurring in arms 41 and 43 as slide 84 is forced forwardly.

At the point illustrated in FIG. 4, the pivotal movements of arms 40 through 43 draws the interior edges of panels 20 and 21 against hull 11. The continued pivotal rearward and inward movement of arms 40 through 43 together with the ball and socket attachments between panels 20 and 21 and arms 40 through 43 pivots panels 20 and 21 upwardly and inwardly as indicated by arrows 142 and 143. This pivotal movement continues until panels 20 and 21 have been drawn inwardly to close in the manner shown in FIG. 5.

FIG. 5 sets forth the section view of FIG. 4 taken along section lines 4—4 in FIG. 3 following the above described closure of panels 20 and 21 upon hull 18 to assume the configuration shown in FIG. 1. It will be recalled that this configuration is maintained so long as the user maintains an inward force upon button 16 (seen in FIG. 1).

More specifically, toy airship 10 includes a hull 11 supporting a post 86. Hull 11 further defines edges 12 and 18 together with an interior cavity 23. Toy airship 10 further includes a cockpit 30 having stops 36 and 38 formed therein. Hull 11 further includes a channel 80 having guide surfaces 81 and 82 formed therein. A slide 84 is movably supported within channel 80 upon surfaces 81 and 82. Slide 84 further defines a slot 85 through which the upper end of post 86 extends. A guide washer 94 and fastener 95 are secured to the upper end of post 86 captivating slide 84 within channel

80. Channel 80 further supports a pair of stop members 110 and 111 each supported upon respective surfaces 82 and 81.

Toy 10 further includes a pair of arms 40 and 42 pivotally secured to slide 84 by respective fasteners 107 and 105 together with respective washers 102 and 100. The outer end of arm 40 defines a socket 70 which receives a ball 60. Ball 60 is secured to panel 20 by a post 50. Similarly, the outer end of arm 42 defines a socket 72 which receives a ball 62. Ball 62 is supported upon panel 21 by a post 52.

In the closed configuration of FIG. 5, panels 20 and 21 are fitted upon edges 12 and 18 respectively and complete the circular cross section of hull 18. With temporary reference to FIG. 1, the closure of panels 20 and 21 completes the elongated airship hull shape for hull 11. Once again it will be understood that the configuration shown in FIG. 5 is maintained so long as the user maintains the pressure upon button 16 (seen in FIG. 1). Once button 16 is released, the above described action in response to spring 109 shown in FIG. 3 is carried forward and the positions of panels 20 and 21 return to the open configuration shown in FIG. 2.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy airship configurable between a closed airship configuration and an open hydrofoil craft configuration, said toy airship comprising:

an elongated hull defining side edges and a rear edge;

a pair of panels formed to fit upon said hull at said side and rear edges;

a slide movably supported within said hull;

a first pair of arms each having a first end pivotally joined to said slide and a second end pivotally joined to one of said panels;

a second pair of arms each having a third end pivotally joined to said slide and a fourth end pivotally joined to the remaining one of said panels, said first and second pairs of arms supporting said panels separate from and spaced from said hull supported solely by said pairs in said open hydrofoil craft configuration;

user operable means for moving said slide between a first position moving said panels to said closed airship configuration and a second position moving said panels to said hydrofoil craft configuration.

2. The toy airship set forth in claim 1 wherein said user operable means includes a push-button to said slide.

3. The toy airship set forth in claim 2 wherein said user operable means includes a spring coupled to said slide urging said slide toward said second position.

4. The toy airship set forth in claim 3 wherein said push-button is supported at a rear portion of said hull.

5. The toy airship set forth in claim 4 wherein said first and second pair of arms each define outer ends having respective ball and socket joints joining said ends to said panels.

6. A toy airship configurable between a closed airship configuration and an open hydrofoil craft configuration, said toy airship comprising:

an elongated hull defining side edges and a rear edge;

a pair of panels formed to fit upon said hull at said side and rear edges;

a slide movably supported within said hull;

a first pair of arms pivotally joined to said slide and pivotally joined to one of said panels;

a second pair of arms pivotally joined to said slide and pivotally joined to the remaining one of said panels;

user operable means for moving said slide between a first position moving said panels to said closed airship configuration and a second position moving said panels to said hydrofoil craft configuration, said user operable means including a push-button to said slide and a spring coupled to said slide urging said slide toward said second position.

7. The toy airship set forth in claim 6 wherein said push-button is supported at a rear portion of said hull.

8. The toy airship set forth in claim 7 wherein said first and second pair of arms each define outer ends having respective ball and socket joints joining said ends to said panels.

* * * * *